US011352725B2

(12) United States Patent
Huang et al.

(10) Patent No.: US 11,352,725 B2
(45) Date of Patent: Jun. 7, 2022

(54) WIRE TENSION CONTROL DEVICE AND BRAIDING MACHINE USING THE SAME

(71) Applicant: INDUSTRIAL TECHNOLOGY RESEARCH INSTITUTE, Hsinchu (TW)

(72) Inventors: Yi-Ping Huang, Taoyuan (TW); Chih-Wei Wu, Xinfeng Township (TW); Yi-Tseng Li, New Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 108 days.

(21) Appl. No.: 17/013,426

(22) Filed: Sep. 4, 2020

(65) Prior Publication Data

US 2021/0189618 A1 Jun. 24, 2021

Related U.S. Application Data

(60) Provisional application No. 62/950,150, filed on Dec. 19, 2019.

(30) Foreign Application Priority Data

May 27, 2020 (TW) ..... 109117721

(51) Int. Cl.
*D04C 3/48* (2006.01)
*D04C 3/38* (2006.01)
(Continued)

(52) U.S. Cl.
CPC ..... *D04C 3/48* (2013.01); *B65H 59/04* (2013.01); *B65H 59/38* (2013.01); *D04C 3/38* (2013.01)

(58) Field of Classification Search
CPC ... D04C 3/14; D04C 3/16; D04C 3/18; B65H 59/38; B65H 59/384; B65H 59/387; B65H 59/04
See application file for complete search history.

(56) References Cited

U.S. PATENT DOCUMENTS 2,365,691 A * 12/1944 Fodor ..... G11B 15/43 242/415.1
3,410,073 A * 11/1968 Brisken ..... D01H 13/1608 57/88
(Continued)

FOREIGN PATENT DOCUMENTS

CN 1955869 A 5/2007
CN 104674439 A 6/2015
(Continued)

OTHER PUBLICATIONS

"Carriers for Braiding Machines" Braiding Technology for Textiles, 2015, pp. 153-175.
(Continued)

*Primary Examiner* — Shaun R Hurley
(74) *Attorney, Agent, or Firm* — Birch, Stewart, Kolasch & Birch, LLP

(57) ABSTRACT

A wire tension control device including a bobbin and a magnetic moment generator is provided. The bobbin is configured to provide a wire. The magnetic moment generator includes a stator and a rotor relatively rotatable with respect to the stator. The rotor is connected to the bobbin. When the bobbin drives the rotor to rotate, the magnetic moment generator generates a tension on the wire.

18 Claims, 8 Drawing Sheets

(51) Int. Cl.
*B65H 59/04* (2006.01)
*B65H 59/38* (2006.01)

(56) References Cited

U.S. PATENT DOCUMENTS

| | | | | |
|---|---|---|---|---|
| 4,420,123 | A * | 12/1983 | Fox | B65H 59/38 242/417 |
| 4,736,668 | A * | 4/1988 | Moyer | D04C 3/16 87/61 |
| 5,732,611 | A * | 3/1998 | Voyer | D04C 3/18 87/57 |
| 5,904,087 | A * | 5/1999 | Freitas | D04C 3/14 87/50 |
| 7,975,591 | B2 * | 7/2011 | Baeumer | D04C 3/16 87/61 |
| 2010/0037759 | A1 * | 2/2010 | Baeumer | D04C 3/16 87/57 |
| 2013/0256447 | A1 * | 10/2013 | Tanigawa | B29C 53/8016 242/419.1 |
| 2014/0034770 | A1 * | 2/2014 | Sloupensky | D01H 13/108 242/364.9 |
| 2016/0176673 | A1 | 6/2016 | Matsumoto et al. | |
| 2016/0243762 | A1 | 8/2016 | Fleming et al. | |
| 2018/0108826 | A1 | 4/2018 | Tajitsu et al. | |
| 2019/0031464 | A1 * | 1/2019 | Feng | B65H 49/26 |
| 2020/0317464 | A1 * | 10/2020 | Mitsuhashi | F16D 63/002 |

FOREIGN PATENT DOCUMENTS

| | | | |
|---|---|---|---|
| CN | 103668625 | B | 5/2016 |
| CN | 106436010 | A | 2/2017 |
| CN | 107324144 | A | 11/2017 |
| CN | 107604517 | A | 1/2018 |
| EP | 2 017 381 | B1 | 6/2012 |
| EP | 2 592 032 | A1 | 5/2013 |
| EP | 2 907 908 | A1 | 8/2015 |
| JP | 4492595 | B2 | 6/2010 |
| JP | 4973142 | B2 | 7/2012 |
| KR | 10-2015-0088963 | A | 8/2015 |
| TW | 101386 | | 7/1988 |
| TW | 436542 | B | 5/2001 |
| TW | M492921 | U | 1/2015 |
| TW | 201802316 | A | 1/2018 |
| TW | I612914 | B | 2/2018 |
| TW | 201820106 | A | 6/2018 |

OTHER PUBLICATIONS

Hu et al. "Tension Modeling and Analysis of Braiding Carriers During Radial-Direction and Axial-Direction Braiding" The Journal of the Textile Institute, Jan. 24, 2019, 13 pages.

Ma et al. "Modeling of the Tension System on a Braiding Machine Carrier" Mechanism and Machine Theory, vol. 47, 2012, pp. 46-61.

Maidl et al. "Development of a Novel Type of Online Monitoring System for the Braiding Process" ECCM18—18th European Conference on Composite Materials Athens, Greece, Jun. 24-28, 2018, pp. 1-9.

Roy et al. "Influence of Braid Carrier Tension on Carbon Fibre Braided Prefroms" Recent Developments in Braiding and Narrow Weaving, Springer International Publishing Switzerland, 2016, pp. 91-102.

Taiwanese Office Action and Search Report for Taiwanese Application No. 109117721, dated May 4, 2021.

Extended European Search Report for European Application No. 20198316.0, dated Mar. 5, 2021.

Huang, "Composite Braiding Process and Its Asplications" Airiti Library. May 1, 2020, pp. 60-68 (10 pages total), with English abstact.

Taiwanese Office Action and Search Report for Taiwanese Applicstion No. 109142364, dated Mar. 28, 2022.

European Communication pursuant to Article 94(3) EPC for European Application No. 20198316.0, dated Apr. 7, 2022.

* cited by examiner

WIRE TENSION CONTROL DEVICE AND BRAIDING MACHINE USING THE SAME

This application claims the benefit of U.S. provisional application Ser. No. 62/950,150, filed Dec. 19, 2019, the subject matter of which is incorporated herein by reference, and this application claims the benefit of Taiwan application Ser. No. 109117721, filed May 27, 2020, the disclosure of which is incorporated by reference herein in its entirety.

TECHNICAL FIELD

The disclosure relates in general to a tension control device and a braiding machine using the same, and more particularly to a wire tension control device and a braiding machine using the same.

BACKGROUND

In the braiding process, the wire provided by a wire provider is braided on a mandrel. The wire provider includes a bobbin and a lever mechanism. Based on the variation of wire tension value during the braiding process, a lever mechanism could repetitively lock the bobbin (such that the wire supply is stopped and the wire tension value is increased) and release the bobbin (such that the wire supply is allowed and the wire tension value is reduced) to stabilize the tension value of the wire. However, under the above mechanical control, the variation of wire tension value is still dissatisfactory, and the braiding quality cannot be effectively increased. Therefore, it has become a prominent task for the industries of the present technical field to provide a technology for reducing the variation of the wire tension value.

SUMMARY

The disclosure is directed to a wire tension control device and a braiding machine using the same.

According to one embodiment, a wire tension control device is provided. The wire tension control device includes a bobbin and a magnetic moment generator. The bobbin is configured to provide a wire. The magnetic moment generator includes a stator and a rotor relatively rotatable with respect to the stator. The rotor is connected to the bobbin. When the bobbin drives the rotor to rotate, the magnetic moment generator generates a tension on the wire.

According to another embodiment, a braiding machine is provided. The braiding machine includes a driver and a wire tension control device. The wire tension control device includes a bobbin and a magnetic moment generator. The bobbin is configured to provide a wire. The magnetic moment generator is disposed on the driver and includes a stator and a rotor relatively rotatable with respect to the stator. The rotor is connected to the bobbin. When the bobbin drives the rotor to rotate, the magnetic moment generator generates a tension on the wire. The driver is configured to wind the wire provided by the wire tension control device on a mandrel.

The above and other aspects of the invention will become better understood with regard to the following detailed description of the preferred but non-limiting embodiment (s). The following description is made with reference to the accompanying drawings.

Figure 1:
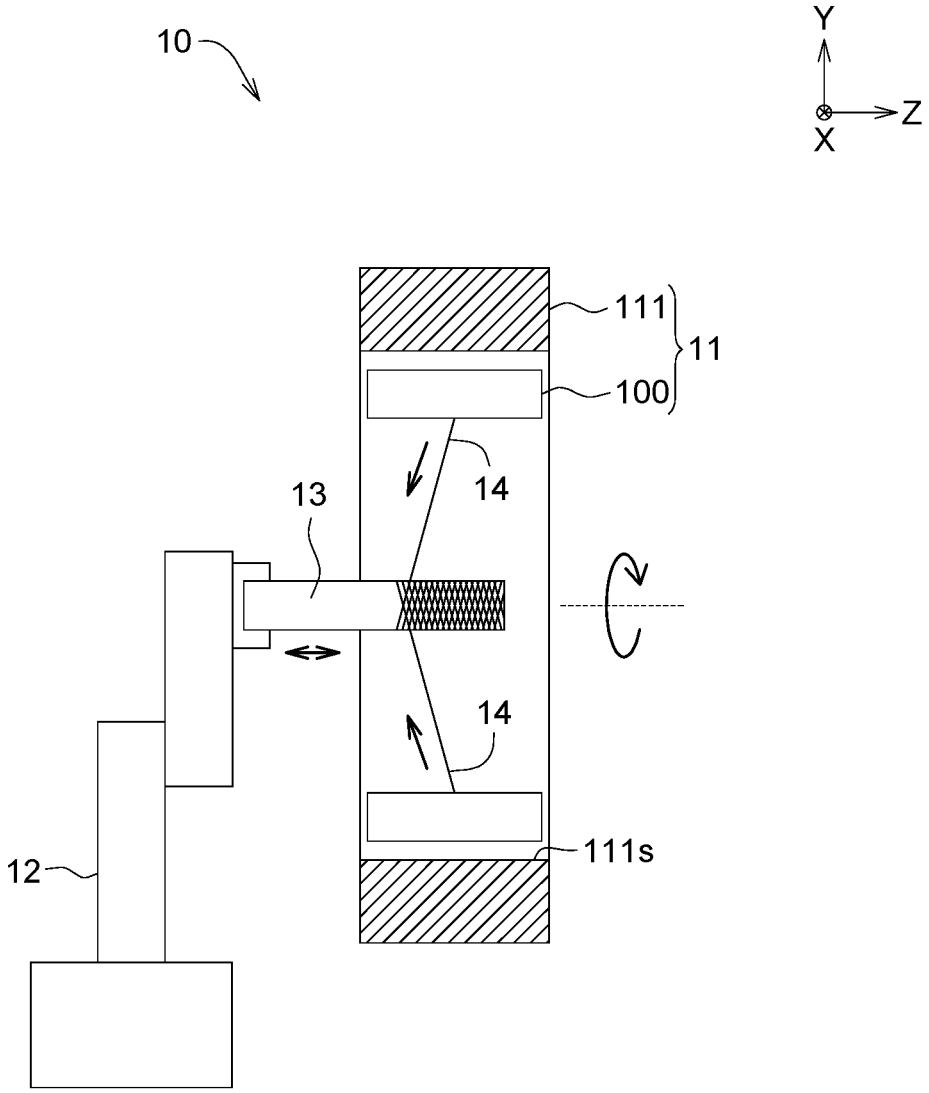
FIG. 1 is a schematic diagram of a braiding system according to an embodiment of the present disclosure.

In the following detailed description, for purposes of explanation, numerous specific details are set forth in order to provide a thorough understanding of the disclosed embodiments. It will be apparent, however, that one or more than one embodiments may be practiced without these specific details. In other instances, well-known structures and devices are schematically shown in order to simplify the drawing.

DETAILED DESCRIPTION

Figure 2:
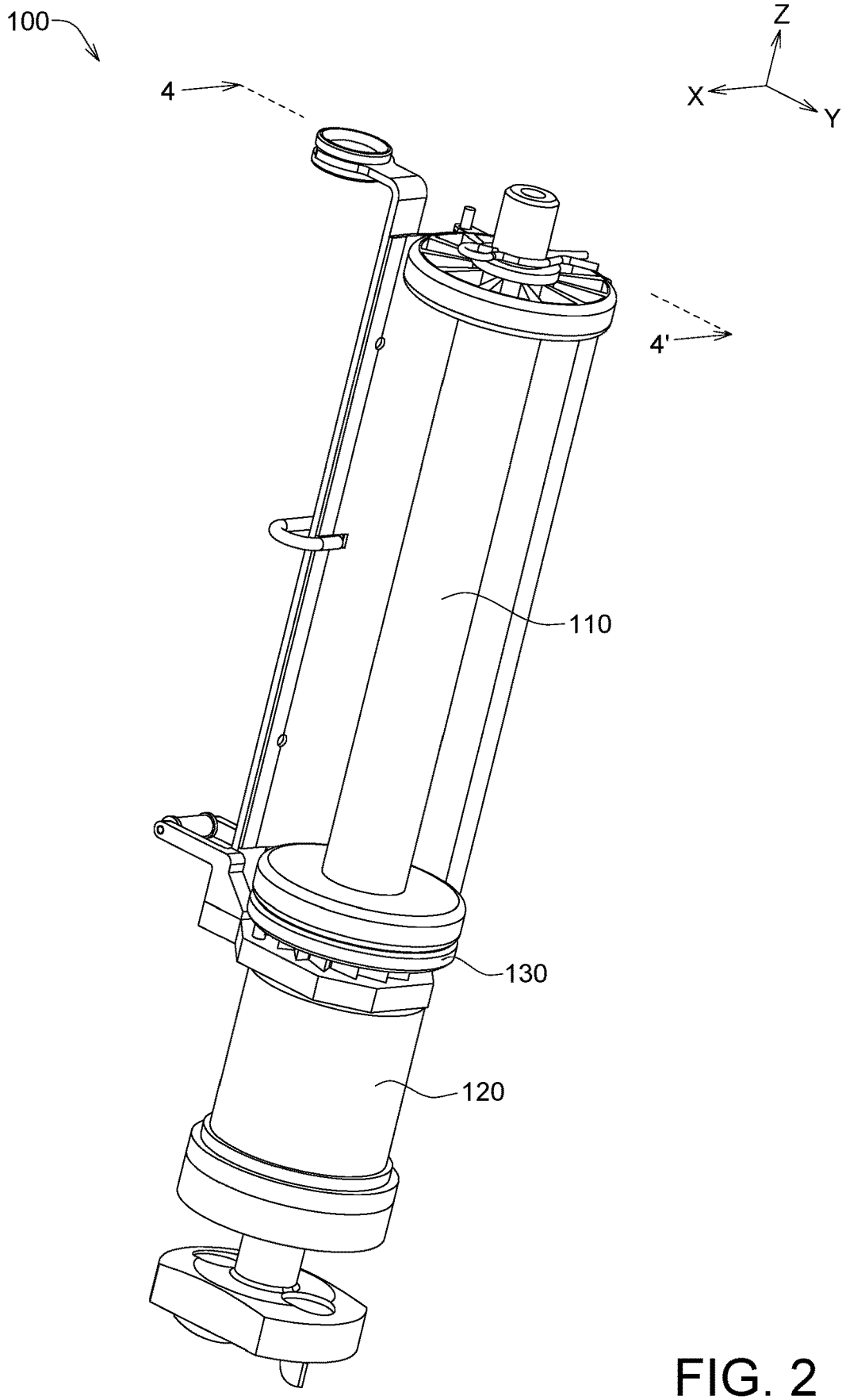
FIG. 2 is a schematic diagram of the wire tension control device of FIG. 1.
Figure 3:
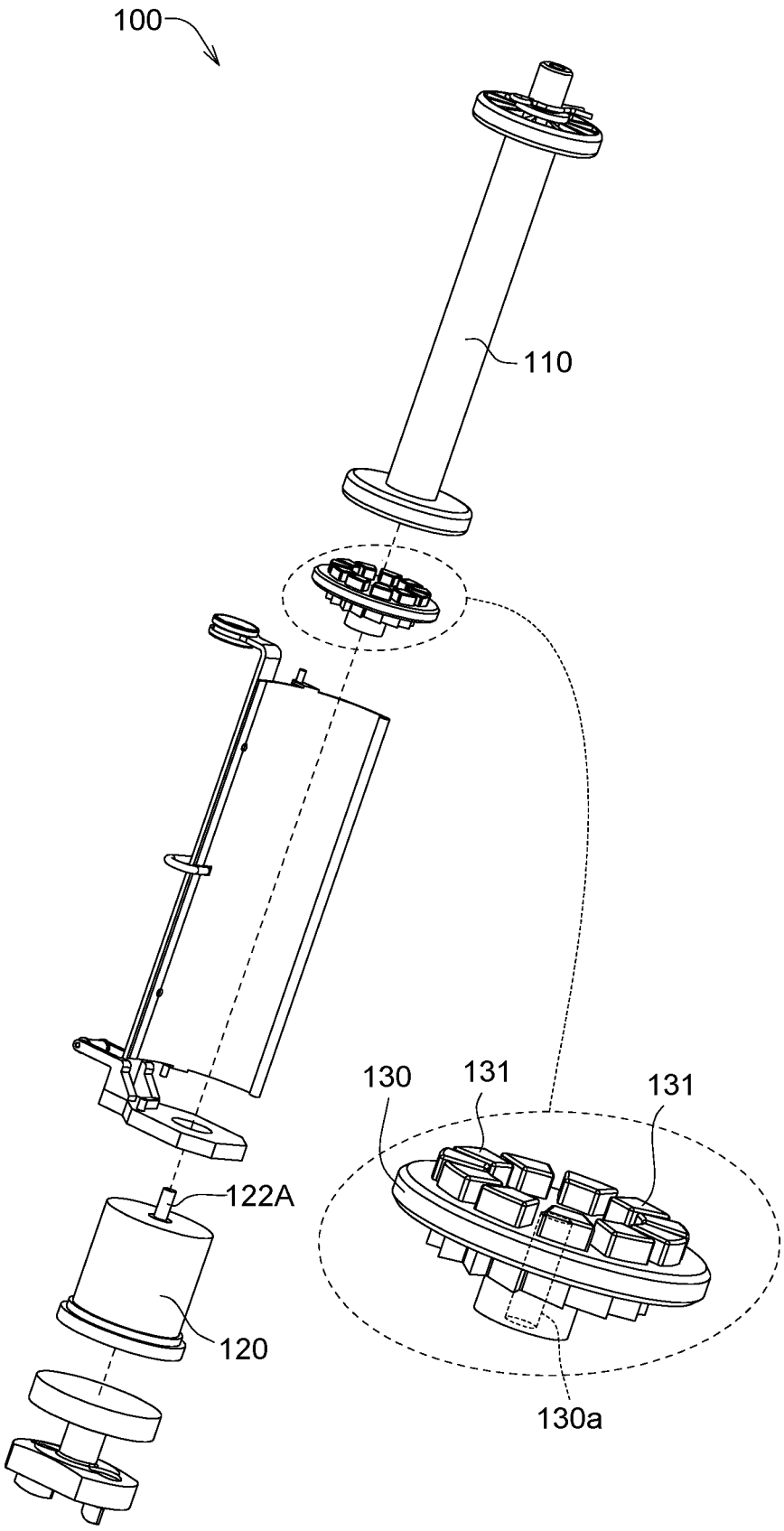
FIG. 3 is an explosion diagram of the wire tension control device of FIG. 2.
Figure 4:
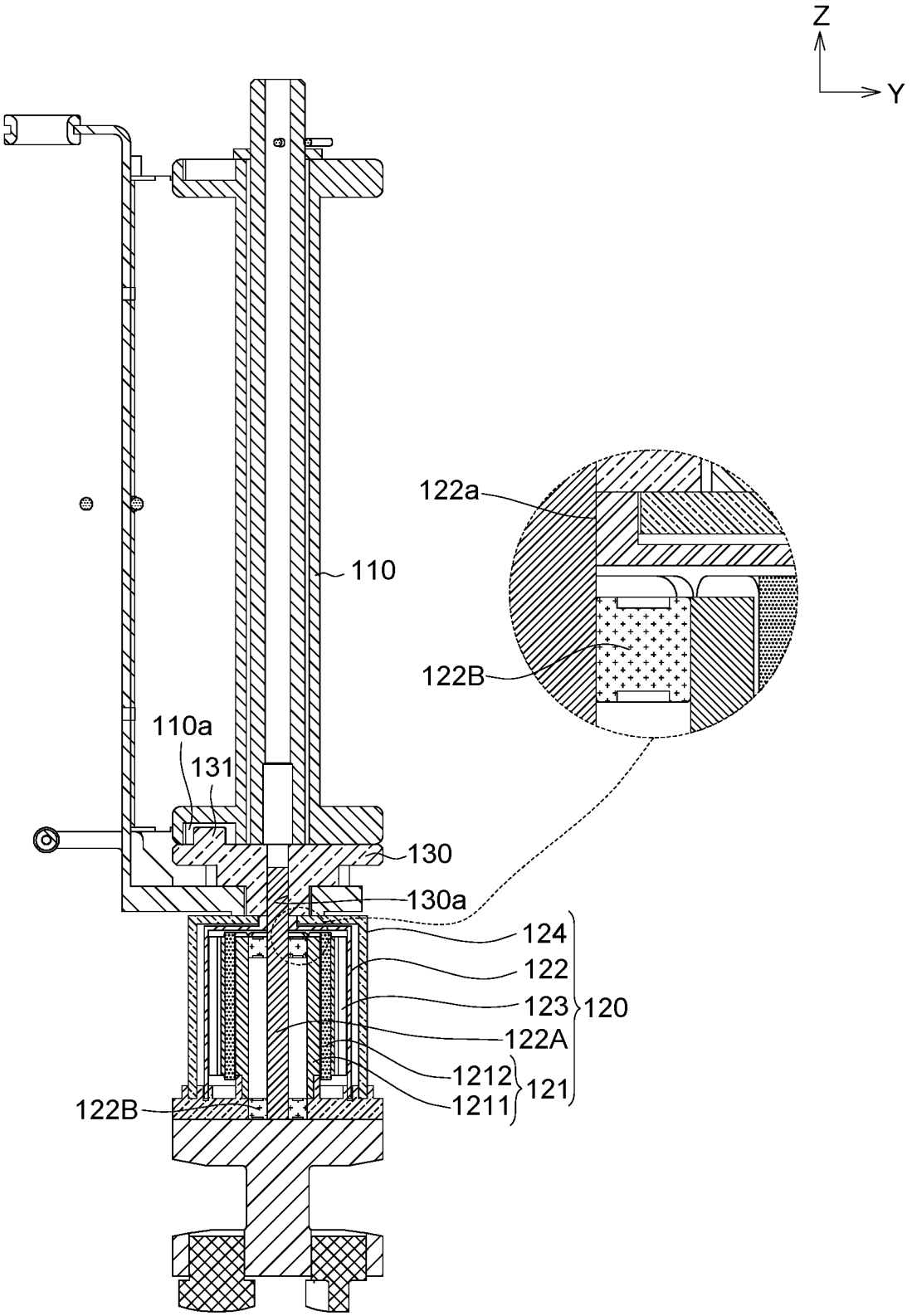
FIG. 4 is cross-sectional view of the wire tension control device of FIG. 2 along a direction 4-4'.
Figure 5:
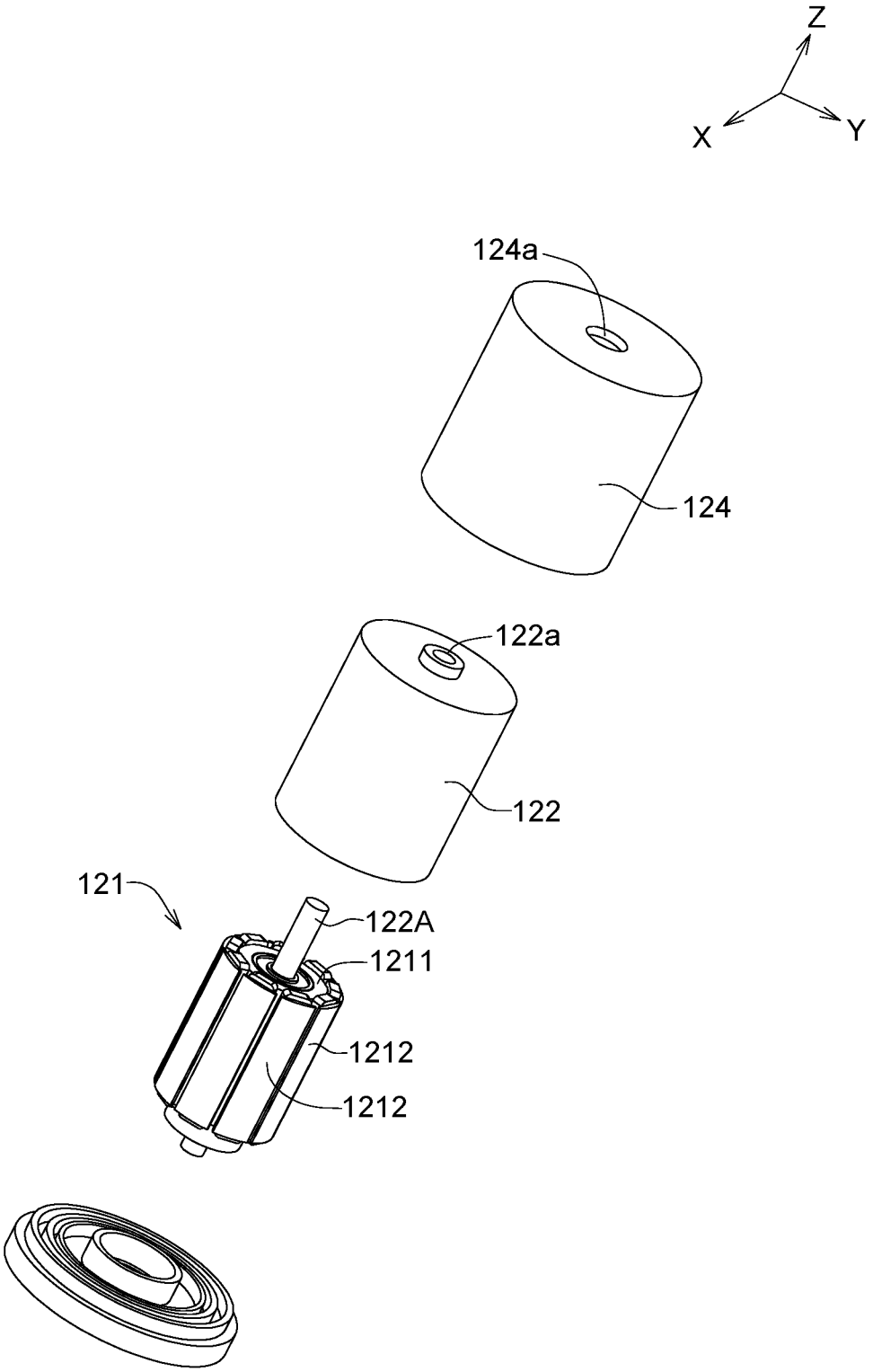
FIG. 5 is an explosion diagram of the magnetic moment generator of FIG. 2.
Figure 6:
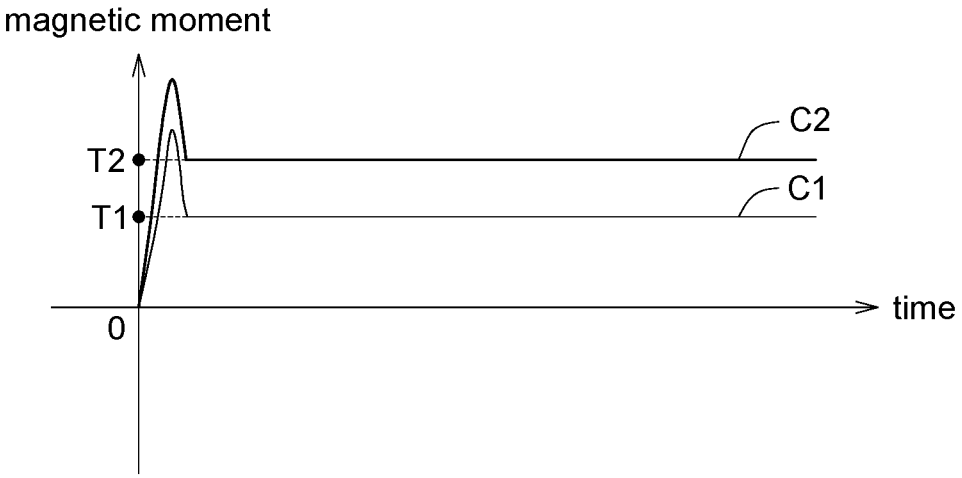
FIG. 6 is a relation diagram of the output of magnetic moment of the magnetic moment generator of FIG. 2 vs time.

Refer to FIGS. 1 to 6. FIG. 1 is a schematic diagram of a braiding system 10 according to an embodiment of the present disclosure. FIG. 2 is a schematic diagram of the wire tension control device 100 of FIG. 1. FIG. 3 is an explosion diagram of the wire tension control device 100 of FIG. 2. FIG. 4 is a cross-sectional view of the wire tension control device 100 of FIG. 2 along a direction 4-4'. FIG. 5 is an explosion diagram of the magnetic moment generator 120 FIG. 2. FIG. 6 is a relation diagram of the output of magnetic moment of the magnetic moment generator 120 of FIG. 2 vs time.

The braiding system 10 includes a braiding machine 11 and a robotic arm 12.

The braiding machine 11 includes at least one wire tension control device 100 and a driver 111. The robotic arm 12 is configured to drive the mandrel 13 to move. The robotic arm 12 could have 6 degrees of freedom, including translating along the X axis, Y axis, and Z axis and rotating around the X axis, Y axis, and Z axis. The robotic arm 12 could drive the mandrel 13 to move at a feeding speed. For example, the mandrel 13 could translate along the Z axis. The driver 111, such as a gear, could rotate to wind the wire 14 on the mandrel 13. For example, the driver 111 could rotate around the Z axis. In another embodiment, depending on the types of the braiding system 10, the motion of the driver 111 is not limited to rotation, and could also be translation or a combination of rotation and translation. As indicated in FIG. 1, at least one wire tension control device 100 surrounds the inner peripheral surface 111*s* of the driver 111 to provide the wire 14 to the mandrel 13. When the driver 111 rotates around the Z axis (the +Z axis or the −Z axis), the driver 111 drives the wire tension control device 100 to rotate around the Z axis and draw the wire 14 on the wire tension control device 100 to be braided on the outer surface of the mandrel 13. After the wire is braided on the mandrel 13, the mandrel 13 covered with the wire 14 is then baked. The wire 14 is formed of a wire body (supporting material) and resin (base material). After covering the mandrel 13, the wire 14 is baked for the resin to be melted and combined with the wire body to form a composite material possessing the feature of high strength. Besides, the wire 14 could be a metal wire formed of any metal element on the periodic table or a composite material, such as carbon fiber or glass fiber which possesses the features of lightweight and high strength; or, the wire 14 could be formed of a textile thread such as yarn or cotton thread.

As indicated in FIGS. 1 to 4, the wire tension control device 100 includes a bobbin 110, a magnetic moment generator 120 and an adaptor 130. The bobbin 110 is configured to provide the wire 14 (illustrated in FIG. 1). For example, the wire 14 could be braided on the bobbin 110 to continuously provide the wire 14 when the bobbin 110 rotates. As indicated in FIG. 3 and FIG. 4, the magnetic moment generator 120 includes a transmission shaft 122A, and the magnetic moment generator 120 includes a stator 121 and a rotor 122 relatively rotatable with respect to the stator. The rotor 122 is connected to the bobbin 110. When the bobbin 110 drives the rotor 122 to rotate (for example, the bobbin 110 rotates around the Z axis and drives the rotor 122 to rotate around the Z axis), the magnetic moment generator 120 generates a tension on the wire 14. Thus, by controlling the magnetic force, the span of variation of the tension of the wire 14 could be reduced during the braiding process, and the braiding quality of the wire 14 braided on the mandrel 13 could be improved.

As indicated in FIGS. 1 to 4, the bobbin 110 and the rotor 122 are fixed, such that when the wire 14 draws the bobbin 110 to rotate, the bobbin 110 synchronically drives the rotor 122 to rotate around the Z axis of FIG. 4. In the present embodiment, the rotor 122 of the magnetic moment generator 120 is driven to rotate by the bobbin 110, and the rotation of the rotor 122 of the magnetic moment generator 120 does not depend on any external power. Moreover, the wire 14 is not in contact with the magnetic moment generator 120 at all; for example, the wire 14 does not contact the stator 121, the rotor 122 or the housing 124 directly.

The description of the magnetic moment generator 120 is exemplified by the application of the magnetic moment generator 120 in a braiding machine. However, the magnetic moment generator 120 could also be used in a textile machine or a motor winding machine. The magnetic moment generator 120 of the present embodiment could be used in any technical field requiring the control of wire tension, such as the wire winding process, the bundle spreading process, or the coiling process.

As indicated in FIG. 4, the magnetic moment generator 120 further includes at least one permanent magnet 123. One of the stator 121 and the rotor 122 may include a core and a coil, and the permanent magnet 123 could be disposed on the other one of the stator 121 and the rotor 122. In the present embodiment, the magnetic moment generator 120 further includes at least one bearing 122B. In addition, the core is, for example, an iron core.

In the present embodiment as indicated in FIGS. 4 and 5, the rotor 122 surrounds the stator 121 (such structure is referred as a "rotor outside-stator inside structure"), wherein the stator 121 includes a core 1211 and a coil 1212 winded on the core 1211. The core 1211 is, for example, an iron core. The permanent magnet 123 is disposed on the inner wall of the stator 121 and is opposite to the coil 1212. In another embodiment, the stator 121 could surround the rotor 122 (such structure is referred as a "rotor inside-stator outside structure"). In the present example, the rotor 122 may include a core and a coil, and the permanent magnet 123 is disposed on the inner wall of the stator 121 and is opposite to the coil of the stator 121. To summarize, in the embodiments of the present disclosure, the stator-rotor mechanism of the magnetic moment generator 120 could be realized by a "rotor inside-stator outside mechanism" or a "rotor outside-stator inside mechanism".

As indicated in FIGS. 4 and 5, the permanent magnet 123 generates a magnetic field. When the rotor 122 rotates, the magnetic field generated by the permanent magnet 123 is varied by the core 1211 and the coil 1212, such that the rotor 122 generates a magnetic moment. As indicated in FIG. 6, curve C1 represents the magnetic moment generate by the magnetic moment generator 120. As indicated in curve C1, except for the surge at the initial stage (a non-working area that could be neglected), the subsequent working area (a straight line that may have stable fluctuations) is a stable output of magnetic moment. The magnetic moment could apply a stable tension to the wire 14 to increase the braiding quality of the wire 14 braided on the mandrel 13.

As indicated in FIG. 5, the rotor 122 has a through hole 122*a*. The magnetic moment generator 120 further includes a transmission shaft 122A. The relative relation between the transmission shaft 122A and the rotor 122 is fixed (that is, there is no relative movement between the transmission shaft 122A and the rotor 122), therefore when the transmission shaft 122A rotates, the transmission shaft 122A could drive the rotor 122 to rotate. As indicated in FIG. 5, the rotor 122 has a through hole 122*a*, and the transmission shaft 122A could pass through the through hole 122 of the rotor 122 to be fixed on the bobbin 110. As indicated in FIG. 4, the transmission shaft 122A of the magnetic moment generator 120 passes through the bearing 122B.

As indicated in FIGS. 4 and 5, the magnetic moment generator 120 further includes a housing 124, which covers and protects the rotor 122 and the stator 121. The housing 124 has a through hole 124*a*. The transmission shaft 122A could pass through the through hole 122*a* of the rotor 122 and the through hole 124*a* of the housing 124 to be fixed on the bobbin 110. Thus, the rotor 122 could synchronically rotate with the bobbin 110.

As indicated in FIG. 4, the adaptor 130 could serve as a connector between the bobbin 110 and the magnetic moment generator 120. For example, the adaptor 130 is disposed between the bobbin 110 and the magnetic moment generator 120 and connects the bobbin 110 and the magnetic moment generator 120, such that the bobbin 110 could be connected to the magnetic moment generator 120 through the adaptor 130. Thus, without changing the original design of the bobbin 110, the bobbin 110 and the magnetic moment generator 120 could be connected through the adaptor 130 and could be rotated synchronically. As indicated in FIGS. 3 and 4, the bobbin 110 of the present embodiment has at least one concave portion 110*a*, and the adaptor 130 includes at least one convex portion 131, wherein the convex portion 131 and the concave portion 110*a* match and interfere with each other. For example, the amount of relative rotation around the Z axis by the adaptor 130 and the bobbin 110 is restricted, such that the bobbin 110 could drive the adaptor 130 to rotate. Additionally, the adaptor 130 further has a fixing hole 130*a*, which could be engaged and fixed with the transmission shaft 122A of the magnetic moment generator 120. Thus, when the bobbin 110 rotates, the bobbin 110, through the adaptor 130, could drive the rotor 122 to rotate. In an embodiment, the transmission shaft 122A and the fixing hole 130*a* could be temporarily or permanently coupled by way of screwing, engagement or soldering. Also, the convex portion 131 of the adaptor 130 and the concave portion 110*a* of the bobbin 110 could fix each other. For example, the convex portion 131 and the concave portion 110*a* are engaged (such as tightly engaged), such that when the bobbin 110 drives the adaptor 130 to rotate, due to the relative movement between the convex portion 131 and the concave portion 110*a* (such as the clearance between the convex portion 131 and the concave portion 110*a*), the bobbin 110 and the adaptor 130 will not collide and generate noises, and the tension response will not be delayed. In another embodiment, as long as the rotation speed of the bobbin 110 does not affect the tension disturbance (for example, the rotation speed of the bobbin 110 is in a range of 27 rpm to 30 rpm, or is higher or lower than the said range), the convex portion 131 and the concave portion 110*a* could be loose fit or transition fit.

In another embodiment, the adaptor 130 could be realized by a magnetic member, and the adaptor 130 and the bobbin 110 are coupled by magnetic attraction. Based on such design, the adaptor 130 could omit the convex portion 131. In other embodiments, the wire tension control device 100 could selectively omit the adaptor 130, and the transmission shaft 122A of the magnetic moment generator 120 could be directly coupled with the bobbin 110.

Figure 7:
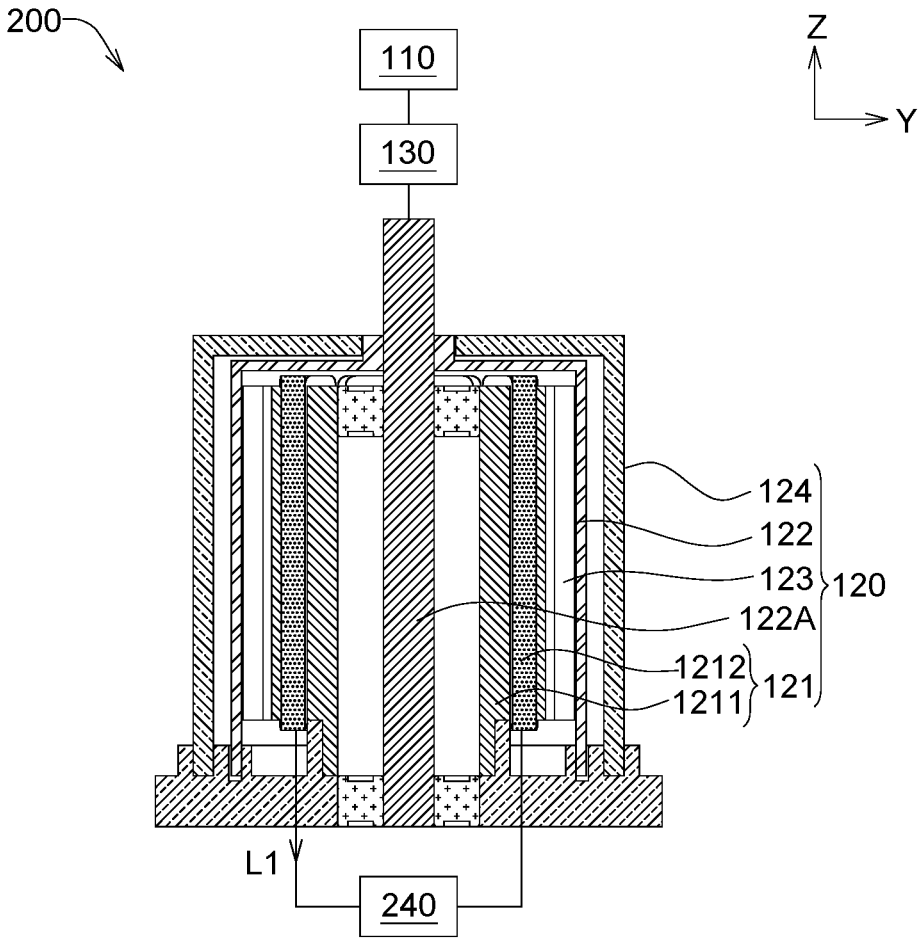
FIG. 7 is a partial cross-sectional view of a wire tension control device according to another embodiment of the present disclosure.

Referring to FIG. 7, a partial cross-sectional view of a wire tension control device 200 according to another embodiment of the present disclosure is shown. The wire tension control device 200 includes a bobbin 110, a magnetic moment generator 120, an adaptor 130 and a load 240. To simplify the diagram, both the bobbin 110 and the adaptor 130 are represented by a block. The wire tension control device 200 of the present embodiment and the wire tension control device 100 have similar or identical technical features except that the wire tension control device 200 further includes a load 240 electrically coupled to the coil 1212, For example, the two electrodes of the load 240 are respectively connected to the two ends of the coil 1212 to form a closed loop, such that the electric current L1 generated by the magnetic moment generator 120 could flow through the load 240.

In an embodiment, the load 240, which could be realized by such as a resistor, consumes the electric current generated by the magnetic moment generator 120 and therefore changes the magnetic moment generated by the magnetic moment generator 120. As indicated in curve C2 of FIG. 6, which represents the magnetic moment generated by the magnetic moment generator 120, except for the surge at the initial stage (a non-working area that could be neglected), the subsequent working area is a stable output of magnetic moment. The magnetic moment could apply a stable tension to the wire 14 to improve the braiding quality of the wire 14 braided on the mandrel 13. A comparison between curve C1 and curve C2 shows that the load 240 of the magnetic moment generator 120 could change or adjust the magnetic moment generated by the magnetic moment generator 120 and therefore change or adjust the tension applied to the wire 14 by the magnetic moment generator 120 during the braiding process. In an embodiment, the resistance of the load 240 could be a fixed value or a variable. In other words, the load 240 could be a fixed resistor or a variable resistor.

Besides, the present embodiment does not restrict the types of the load 240, and the load 240 could be an electronic device, such as a display or a wireless communication module. Thus, the load 240 of the wire tension control device 200 not only could be configured to enable the electric current L1 generated by the magnetic moment generator 120 during the braiding process to perform specific function, and could further be configured to change or adjust the magnetic moment generated by the magnetic moment generator 120 of the wire tension control device 200.

Figure 8:
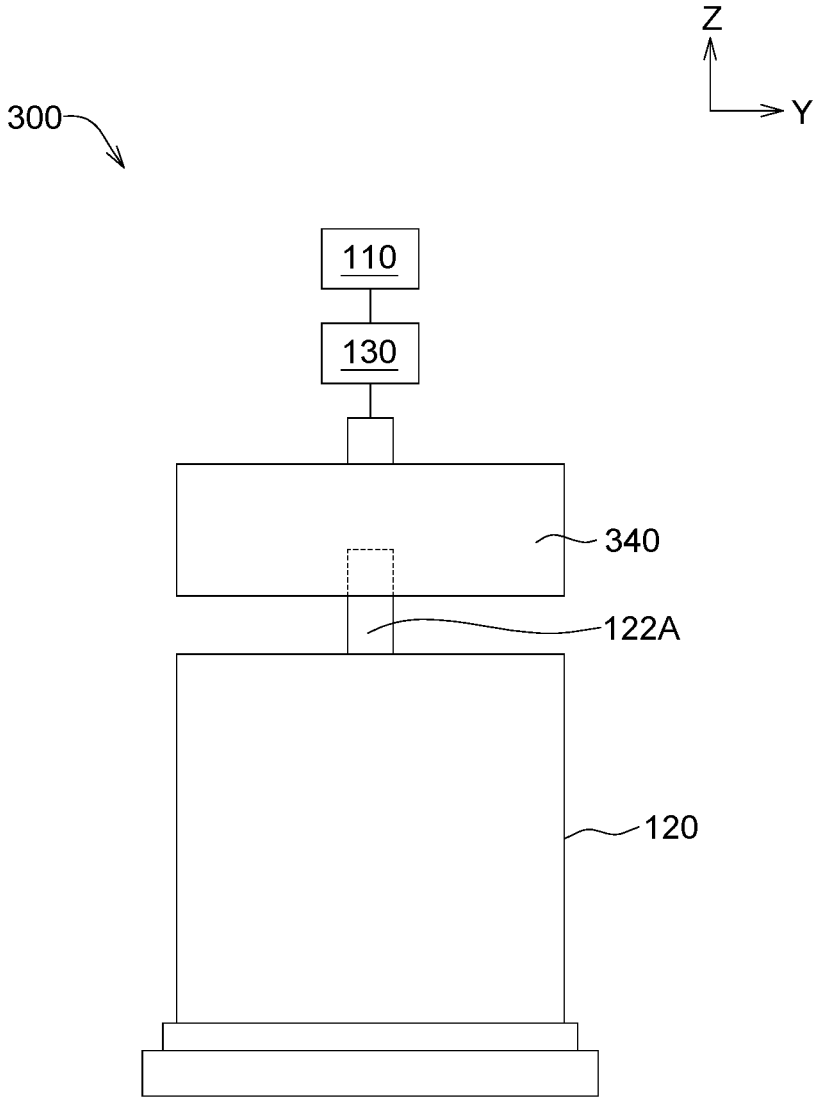
FIG. 8 is a partial cross-sectional view of a wire tension control device according to another embodiment of the present disclosure.

Referring to FIG. 8 a partial cross-sectional view of a wire tension control device 300 according to another embodiment of the present disclosure is shown. The wire tension control device 300 includes a bobbin 110, a magnetic moment generator 120, an adaptor 130 and a speed control mechanism 340, such as a gear box. To simplify the diagram, both the bobbin 110 and the adaptor 130 are represented by a block. The wire tension control device 300 of the present embodiment and the wire tension control device 100 have similar or identical technical features except that the wire tension control device 300 further includes the speed control mechanism 340. The speed control mechanism 340 is connected to the rotor 122. For example, the speed control mechanism 340 is connected to the rotor 122 through the transmission shaft 122A, and therefore changes the variation ratio (for example, increase or reduce). For example, the speed control mechanism 340 could adjust the gear ratio of the gear box and provide different torques to the bobbin 110 to adjust the tension of the wire 14.

Figure 9:
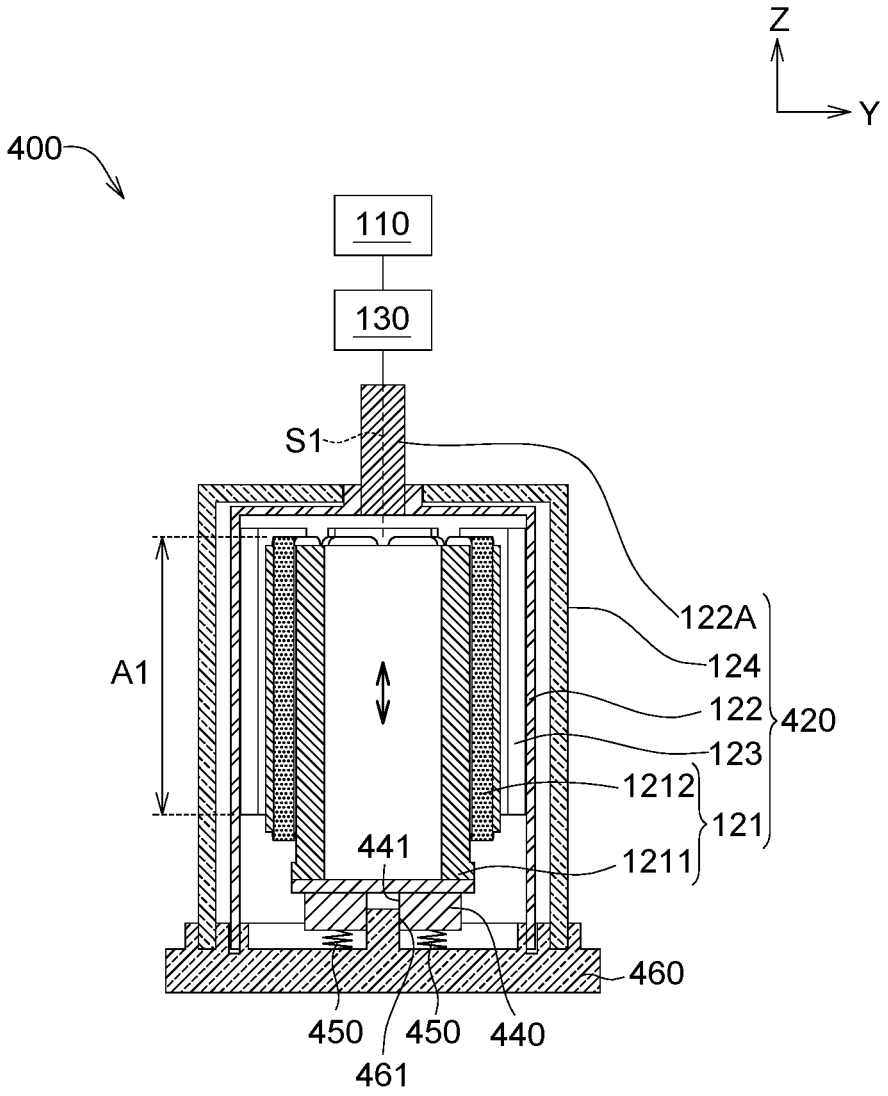
FIG. 9 is a partial cross-sectional view of a wire tension control device according to another embodiment of the present disclosure.

Referring to FIG. 9, a partial cross-sectional view of a wire tension control device 400 according to another embodiment of the present disclosure is shown. The wire tension control device 400 includes a bobbin 110, a magnetic moment generator 420, an adaptor 130, a course adjustment element 440, an anti-loose element 450 and a base 460. To simplify the diagram, both the bobbin 110 and the adaptor 130 are represented by a block. The wire tension control device 400 of the present embodiment and the wire tension control device 100 have similar or identical technical features except that the wire tension control device 400 further includes the course adjustment element 440, the anti-loose element 450 and the base 460.

In the present embodiment, the magnetic moment generator 420 includes a stator 121, a rotor 122 relatively rotatable with respect to the stator 121, a permanent magnet 123 and a housing 124. The magnetic moment generator 420 of the present embodiment and the magnetic moment generator 120 have similar or identical structures except that the magnetic moment generator 420 could omit the bearing 122B (as indicated in FIG. 4).

The course adjustment element 440 is connected to (for example, fixed with) the stator 121 and is configured to adjust the position of the stator 121 along the extension direction S1 of the transmission shaft 122A (for example, along the Z axis) to change the overlapping area A1 between the coil 1212 and the permanent magnet 123 along the extension direction S1 of the transmission shaft 122A. By changing the overlapping area A1, the magnetic moment generated by the magnetic moment generator 420 during the braiding process could be changed accordingly. The larger the overlapping area A1, the larger magnetic moment generated by the magnetic moment generator 420 during the braiding process. Conversely, the smaller the overlapping area A1, the smaller the magnetic moment generated by the magnetic moment generator 420 during the braiding process.

Moreover, in the present embodiment, the position of the stator 121 is adjustable. As indicated in FIG. 9, the base 460 has an outer screw 461, and the course adjustment element 440 has an inner screw 441, wherein the inner screw 441 and the outer screw 461 could rotate relatively to be engaged with each other. Thus, the position of the course adjustment element 440 along the extension direction S1 of the transmission shaft 122A could be adjusted to change the overlapping area A1 between the coil 1212 and the permanent magnet 123 along the extension direction S1 of the transmission shaft 122A.

As indicated in FIG. 9, the anti-loose element 450 is located between the base 460 and the course adjustment element 440. The anti-loose element 450 could fix or stable relative positions between the stator 121 and the base 460 to avoid the position of the stator 121 being easily changed and avoid the overlapping area A1 between the coil 1212 and the permanent magnet 123 along the extension direction S1 of the transmission shaft 122A being easily changed. Thus, the magnetic moment generator 420 could generate a stable magnetic moment during the braiding process. In the present embodiment, the anti-loose element 450 could be realized by an elastic element such as spring. The quantity of anti-loose element 450 could be one or more than one. When the quantity of anti-loose element 450 is more than one, the pleural anti-loose elements 450 could be disposed surrounding the outer screw 461 of the base 460. When the quantity of anti-loose element 450 is one, the coil of the anti-loose element 450 could continuously surround the outer screw 461 of the base 460. In another embodiment, the anti-loose element 450 could be realized by a pad or other elastomer capable of stabilizing relative positions between the base 460 and the course adjustment element 440.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A wire tension control device, comprising:
a bobbin configured to provide a wire; and
a magnetic moment generator, comprising a stator and a rotor relatively rotatable with respect to the stator, wherein the rotor is connected to the bobbin, and the magnetic moment generator generates a tension on the wire when the bobbin drives the rotor to rotate;
wherein the stator or the rotor comprises:
a core; and
a coil winded on the core;
wherein the wire tension control device further comprises a load electrically coupled to the coil for consuming electric current generated by the magnetic moment generator and changing the tension generated by the magnetic moment generator.

2. The wire tension control device according to claim 1, wherein the load is a resistor.

3. The wire tension control device according to claim 1, wherein the load is an electronic device.

4. The wire tension control device according to claim 3, wherein the electronic device is a wireless communication module or a display.

5. The wire tension control device according to claim 1, wherein the position of the stator is adjustable.

6. The wire tension control device according to claim 5, wherein the magnetic moment generator further comprises a transmission shaft, and the wire tension control device further comprises:
a course adjustment element connected to the stator and configured to adjust the position of the stator along the extension direction of the transmission shaft.

7. The wire tension control device according to claim 6, further comprising:
a base having an outer screw;
wherein the course adjustment element has an inner screw, and the inner screw and the outer screw are relatively rotatable to be engaged with each other.

8. The wire tension control device according to claim 7, further comprising:
an anti-loose element located between the base and the course adjustment element.

9. The wire tension control device according to claim 1, further comprising:
a speed control mechanism connected to the rotor and configured to change the rotation speed of the rotor.

10. The wire tension control device according to claim 1, wherein the wire is not in contact with the magnetic moment generator.

11. A braiding machine, comprising:
a driver; and
a wire tension control device disposed on the driver and comprising:
a bobbin configured to provide a wire; and
a magnetic moment generator, comprising a stator and a rotor relatively rotatable with respect to the stator, wherein the rotor is connected to the bobbin, and the magnetic moment generator generates a tension on the wire when the bobbin drives the rotor to rotate;
wherein the driver is configured to braid the wire provided by the wire tension control device on a mandrel;
wherein the stator or the rotor comprises:
a core; and
a coil winded on the core;
wherein the wire tension control device further comprises a load electrically coupled to the coil for consuming electric current generated by the magnetic moment generator and changing the tension generated by the magnetic moment generator.

12. The braiding machine according to claim 11, wherein the load is a resistor.

13. The braiding machine according to claim 11, wherein the load is an electronic device.

14. The braiding machine according to claim 13, wherein the electronic device is a wireless communication module or a display.

15. The braiding machine according to claim 11, wherein the position of the stator is adjustable.

16. The braiding machine according to claim 15, wherein the magnetic moment generator further comprises a transmission shaft, and the wire tension control device further comprises:
a course adjustment element connected to the stator and configured to adjust the position of the stator along the extension direction of the transmission shaft.

17. The braiding machine according to claim 16, further comprising:
a base having an outer screw;
wherein the course adjustment element has an inner screw, and the inner screw and the outer screw are relatively rotatable to be engaged with each other.

18. The braiding machine according to claim 17, further comprising:
an anti-loose element located between the base and the course adjustment element.

* * * * *